United States Patent [19]

Tschacher

[11] 4,302,910

[45] Dec. 1, 1981

[54] PNEUMATICALLY OPERATED GRINDING APPARATUS

[75] Inventor: Hans-Dieter Tschacher, Reichenbach, Fed. Rep. of Germany

[73] Assignee: Festo-Maschinenfabrik Gottlieb Stoll, Esslingen, Fed. Rep. of Germany

[21] Appl. No.: 125,391

[22] Filed: Feb. 27, 1980

[30] Foreign Application Priority Data

Mar. 1, 1979 [DE] Fed. Rep. of Germany ..... 2907930

[51] Int. Cl.[3] ..... B24B 23/00; B24B 55/06

[52] U.S. Cl. ..... 51/170 MT; 51/273; 51/134.5 F

[58] Field of Search ..... 51/170 MT, 170 R, 273, 51/134.5 F, 170 PT, 170 T; 125/13 R

[56] References Cited

U.S. PATENT DOCUMENTS

| | | | |
|---|---|---|---|
| 3,843,198 | 10/1974 | Reynolds | 125/13 R |
| 3,964,212 | 6/1976 | Karden | 51/170 PT |
| 4,102,083 | 7/1978 | Stern | 51/134.5 F |
| 4,145,848 | 3/1979 | Hutchins | 51/273 |

*Primary Examiner*—Roscoe V. Parker

*Attorney, Agent, or Firm*—Blanchard, Flynn, Thiel et al.

[57] ABSTRACT

A pneumatically operated grinding apparatus having a dust removal structure. The grinding apparatus has a housing and a movable work plate which is driven by a compressed-air motor. An inlet piping connection is provided for compressed air and is connected in fluid circuit with an inlet opening of the compressed-air motor. A suction piping connection is also provided which is connected to the inside of the housing and to which a suction device can be connected. A discharge-air piping connection is provided which is connected to an outlet of the compressed-air motor and is guided outwardly from the housing.

10 Claims, 2 Drawing Figures

PNEUMATICALLY OPERATED GRINDING APPARATUS

FIELD OF THE INVENTION

The invention relates to a pneumatically operated grinding apparatus.

BACKGROUND OF THE INVENTION

In such known grinding apparatus the outlet opening of the compressed-air motor communicates with the suction piping connection through a hose to the suction device for sucking off the grinding dust.

This has the disadvantage that the grinding apparatus must be designed for high performance, since it must not only absorb the amount of air which is needed for the suction of the grinding dust but also for the discharge air of the compressed-air motor. It is disadvantageous in this solution, since the oil which is contained in the discharge air cakes the grinding dust together to form to a connected mass in the suction device and is very poor in permitting air to pass therethrough.

The present invention is to provide a further development of a grinding apparatus so that it can be used together with a suction device having a low output.

In the inventive grinding apparatus, the discharge air is collected and discharged separately, and the suction device needs to be designed only for the air flow which is necessary for sucking off of the grinding dust. The grinding dust also does not come into contact with the oil traces and thus does not cake together in the filter of the suction device. Thus this filter also does not need to be cleaned as often; a cleaning of the filter which becomes necessary is simpler, since the filter cake can easily be removed from it.

With a further development of the invention, a compact arrangement of the hoses which carry the compressed air and discharge air is obtained. Furthermore one obtains in a very simple manner the requirement of providing differently sized cross-sectional dimensions for the hoses, as it must be chosen in view of the volume increase of the flow medium created during the exhaust of the compressed air in the compressed air motor.

With a still further development of the invention, it is achieved on the one side, that the entire hose arrangement can be handled externally as one unit. It is thereby particularly advantageous that the suction hose, which conducts the sucked-off air or the air-dust mixture, be designed mechanically strong because of the underpressure existing in it and thus also can hold together the hoses which lie particularly well in it. Furthermore in this manner one obtains also the desired large cross section for the suction piping connection and the suction hose, as it is desired in view of an unreduced forwarding of the suction output of the suction device to the grinding apparatus.

A still further development of the invention is preferable in view of the simple handling of the grinding apparatus. In the known grinding apparatus, several hoses for the air supply and air exhaust of the grinding apparatus started out from the apparatus itself, which hoses were able to get caught on the edges and corners of the workpiece. A "hose salad" is now avoided with the invention.

With a still further development of the invention, a splitting up of the common hose arrangement into individual hoses which extend in different directions is obtained in a very simple manner.

In a grinding apparatus embodying the invention, a minimum number of hoses exist also behind the adapter. The discharge air of the motor is exhausted through the deadener at the adapter to the atmosphere, which does not interfere since the adapter can be a considerable distance away from the actual working place.

Of course, it is possible to also choose a different form for the adapter, thus for example it may be round or cylindrical, if other situations permit this to be necessary.

The further development of the invention permits the use of the same hose material for the suction hose between the grinding apparatus and the adapter and between the adapter and the suction device.

The further development of the invention is advantageous in view of the secure placement of the adapter on a base and in view of the moving and removing of various hoses by rotation.

In a grinding apparatus embodying the invention, only two hoses need to exist for the air supply and the air exhaust for the grinding apparatus. The direct mounting of the deadener in the discharge-air piping connection is particularly not disadvantageous for grinding apparatus having a low work performance, since the discharge air exits from the deadener practically completely relaxed and diffused.

BRIEF DESCRIPTION OF THE DRAWINGS

The invention will be discussed in greater detail hereinafter with reference to one exemplary embodiment and with reference to the enclosed drawings, in which.

DETAILED DESCRIPTION

Figure 1:
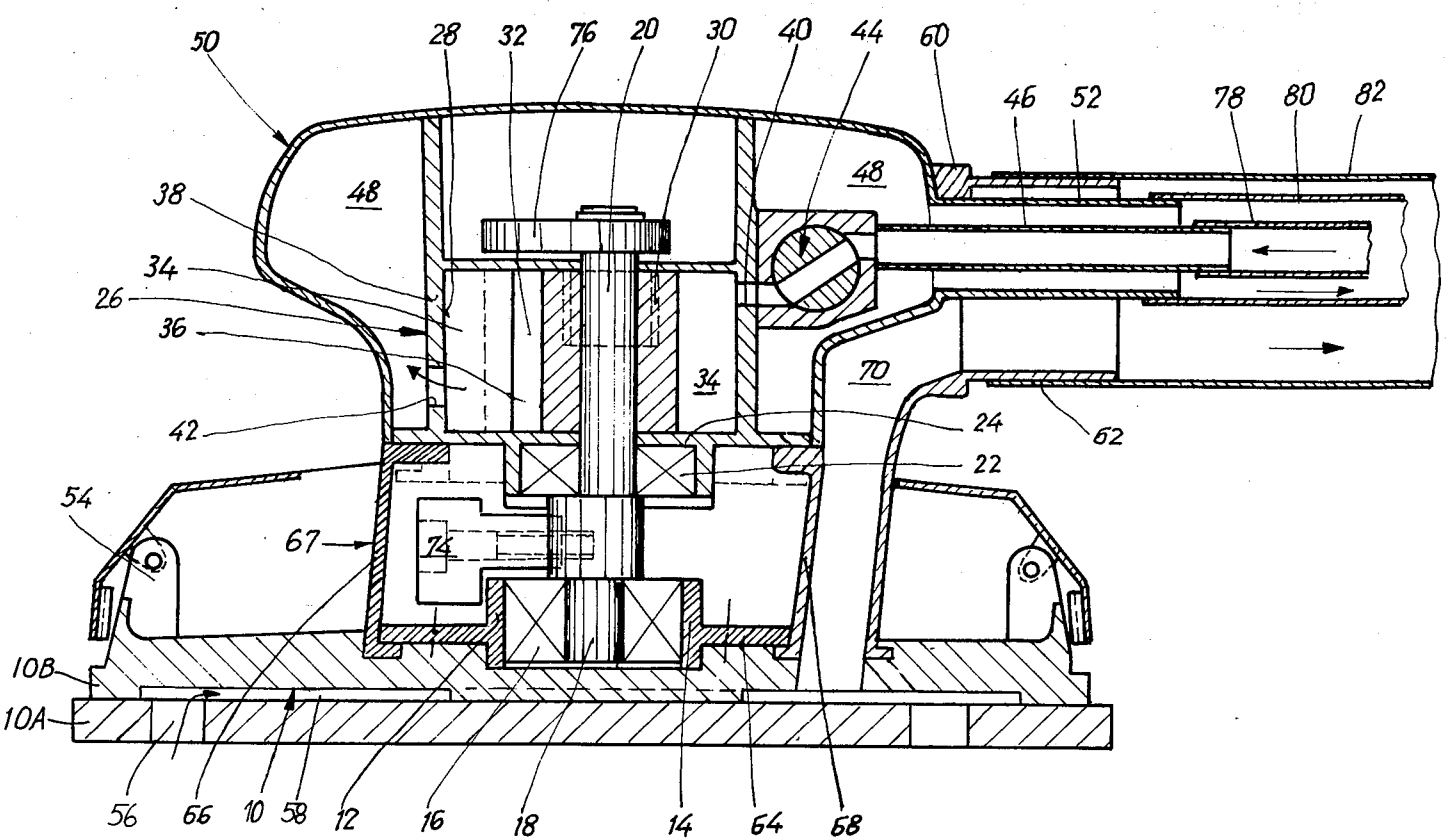
FIG. 1 is a longitudinal cross-sectional view of a pneumatically operated grinding apparatus embodying the invention.

FIG. 1 illustrates a pneumatically operated grinding apparatus having a two-part work plate 10 composed of parts 10A and 10B, to which part 10A an abrasive paper (not shown) can be clamped. The work plate 10 has on its upper side two upright walls 12, 14 which serve as a guide for an outer race of an eccentric roller formed by a roller bearing 16. The roller bearing 16 is mounted with its inner race fixedly engaging an eccentric end section 18 of a drive shaft 20. The drive shaft 20 is supported through a further roller bearing 22 in the bottom wall 24 of a motor housing 26. The latter is represented schematically in the drawing as a one-piece housing and consists as a rule of a plurality of closely connected housing segments. Further details concerning the design of the apparatus and the drive will be understood by skilled persons and, therefore, further discussion thereof is believed unnecessary.

The drive shaft 20 has secured thereto in a work chamber 28 of the motor housing 26 a hub member 30 having radially outwardly opening grooves 32. The axis of the hub 30 is laterally offset with respect to the axis of the drive shaft 20. Sealing blades 34 are arranged radially movably in the grooves 32 so that they will be thrown radially outwardly by the centrifugal force, for example, during rotation of the shaft 20. The drive shaft 20, the hub member 30 and the sealing blades 34 form together the rotor of a rotation piston machine.

An inlet opening 40 for compressed air is constructed in a section of the peripheral wall 38 of the motor housing 26 and which defines the work chamber 28, which section is located closest to the axis of the drive shaft 20. An outlet slot 42 for the exhaust air is elongated in the peripheral direction starting at the section of the peripheral wall 38 farthest removed from the axis of the drive shaft 20 and terminating adjacent the inlet opening 40, so that during the returning of a sealing blade to the inlet opening, a compression of air does not occur.

The inlet opening 40 is connected through a rotary slide valve 44 to an inlet piping connection 46. The outlet slot 42 is connected to a discharge-air collecting chamber 48 defined on the inside thereof by the outside wall of the motor housing 26 and on the outside thereof by an apparatus housing 50. The chamber 48 is connected to and communicates with a discharge-air piping connection 52 which is formed by the housing structure 50 and which coaxially surrounds the inlet piping connection 46.

The work plate 10 has openings 56 therein which communicate with an annular chamber 58 formed between the two parts 10A and 10B. The chamber 58 is, in turn, connected to and communicates with a suction channel 70, which can be constructed bellowslike.

A bottom flange 64 and edge walls 66, 68 are appropriately formed and connected to the walls 12 and 14, which together form a cup-shaped protective housing 67 surrounding the roller bearings 16 and 22 and the end section of the drive shaft 20. In this manner, the grinding dust is prevented from penetrating into the roller bearing 16 and 22.

The eccentric portion 18 of the drive shaft 20 is balanced at two points, for example by balancing weights 74,76 fastened to the drive shaft 20.

A pressure hose 78 is moved onto and is connected to the inlet piping connection 46. A discharge-air hose 80 is moved onto and connected to the discharge-air piping connection 52. A suction-air hose 82 is moved onto and is connected to the suction piping connection 62. The pressure hose 78 is a common flexible hose which is designed for the operating pressure of the grinding apparatus. The discharge-air hose 80 is a relatively thin flexible hose, which is completely sufficient (and is advantageous in view of the movability of the entire coaxial hose arrangement), since the discharge air in the hose 80 is under a higher pressure than the sucked-off air in the hose 82, so that also the wall of the discharge-air hose 80 is subject to tension in the peripheral direction. The suction hose 82 must be sufficiently strong that it does not collapse under the underpressure which exists in it; on the other hand this hose too is not to influence too much the flexibility of the entire coaxial hose arrangement. Therefore, a bellowslike hose is used. All these hoses can be obtained as plastic hoses in the marketplace.

One recognizes that only one single hose appears from the outside to be connected to the grinding apparatus and must be moved together with the grinding apparatus. With this arrangement, the convenience in handling of the grinding apparatus is substantially improved and the danger of snagging the hose on edges and corners of the workpiece is substantially reduced.

Figure 2:
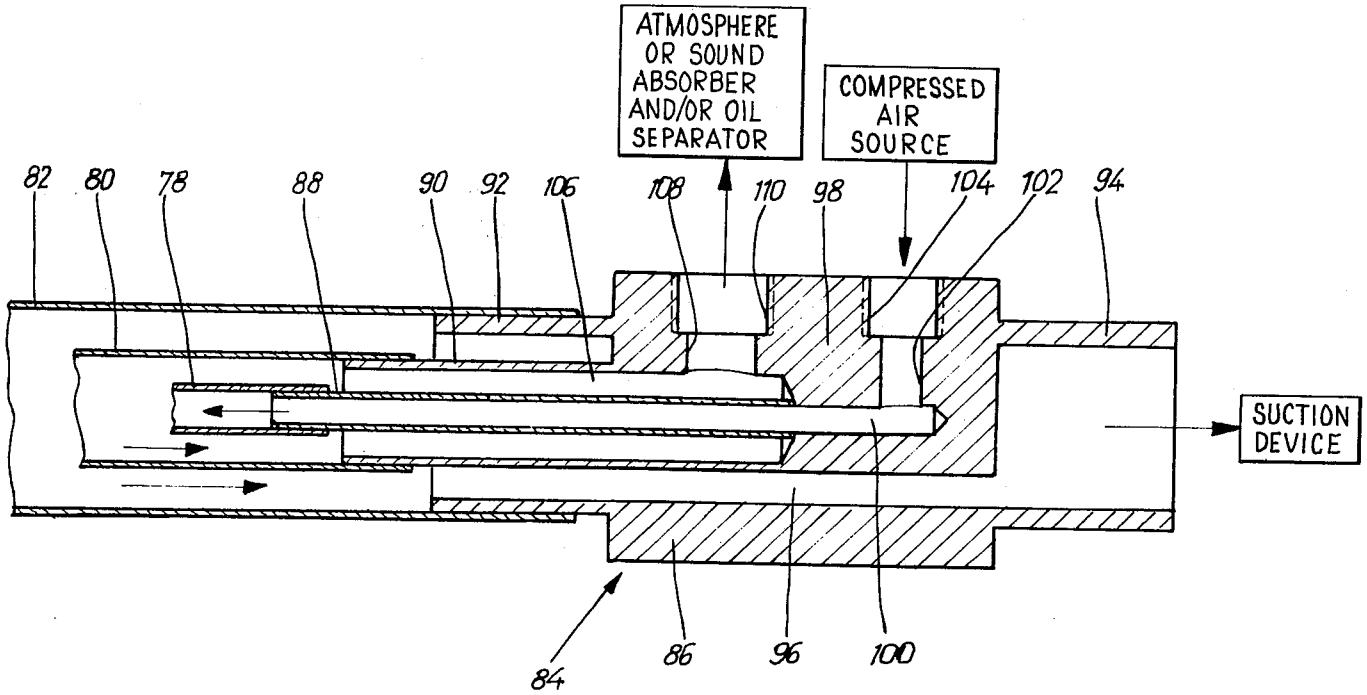
FIG. 2 is an axial cross-sectional view of an adapter, through which a single hose which is connected to a suction device, an individual hose which is connected to a compressed-air source and a deadener which is connected to the outside atmosphere and is at the same time oil-separating, can be connected to a coaxial arrangement which extends to the grinding apparatus illustrated in FIG. 1.

FIG. 2 illustrates an adapter which as a whole is identified by the reference numeral 84 and through which a transition is created between the individual supply hoses for supplying and evacuating of the grinding apparatus and the coaxial hose arrangement.

The adapter 84, which is a single or multipart plastic molded part, has in the illustrated exemplary embodiment a substantially square-shaped main body 86. The shape of the main body may, however, also be different, for example it may be cylindrical or round. On the side adjacent the grinding apparatus, coaxially arranged tubes of increasing diameter are formed onto the main member 86: a first connecting tube 88, the outside diameter of which corresponds with the outside diameter of the inlet piping connection 46 and onto which the second end of the pressure hose 78 is fixedly fastened; a second connecting tube 90, the outside diameter of which corresponds with the outside diameter of the discharge-air piping connection 52 and onto which the second end of the discharge-air hose 80 is fixedly fastened; and a third connecting tube 92, the outside diameter of which corresponds with the outside diameter of the suction piping connection 62 and onto which the second end of the suction hose 82 is fixedly fastened.

The main body 86 of the coaxial connecting tube arrangement has on the opposite side remote from the grinding apparatus a coaxial connecting tube 94. The outside diameter of the tube 94 equals the outside diameter of the suction piping connection 62 and the third connecting tube 92—the aforementioned diameters, however, do not need to be absolutely the same—and which can be connected through a not illustrated, fixedly fastened hose of the same material as the suction hose 82 to a not shown suction device. The connection to the not illustrated suction device may, however, also occur directly, without a hose. The connecting tube 94 communicates with the third connecting tube 92 through a graduated ring chamber 96 radially offset from the central axis, the radially outer limit of which is a continuation of the inner wall of the third connecting tube 92 and the connecting tube 94 and the radially inner limit of which is defined by a partial cylindrical support block 98, which carries the first connecting tube 88 and the second connecting tube 90.

A first longitudinal channel 100 is constructed in the support block 98, which channel is an extension of the inside of the first connecting piece and is connected through a radial channel section 102 to a connecting opening 104, into which a connecting pipe (not illustrated) can be screwed for facilitating a supply or compressed air.

A second longitudinal channel 106 is provided in the support block 98 and is an extension of the inside of the second connecting tube 90 and is connected through a radial channel section 108 to a second connecting opening 110, into which a sound absorber or an oil separator (not illustrated) can be secured therein, which is directly connected to the atmosphere. In place of it, it is also possible to screw in a connecting pipe to facilitate an air discharge through a discharge-air hose.

The aforementioned connections, however, can also be created in a different manner than by screwing, for example as snap or plug-in connection. The adapter 84 is during operation provided a greater distance away from the grinding apparatus, so that it remains stationary during the movement of the grinding apparatus. Also in the case of grinding apparatus having a high output, the exhaust air which is emitted from the sound absorber or the oil separator is so far away from the actual working place that no grinding dust whatsoever is raised or blown around. The block-shaped design of the main body 86 facilitates a secure placement of the adapter on a plane base or a slight temporary clamping; one can so easily hold or clamp the adapter, when the various hoses are rotatingly telescoped under a press fit onto the various connecting tubes of the adapter or are removed therefrom.

It is possible in different, not illustrated embodiments to make the adapter connectible directly to connecting tubes on the suction device.

In a different variation, the arrangement can be such that the adapter is integrated in a suction system having an integrated supply port and an evacuation port, so as to facilitate a compact building foundation.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a pneumatically operated grinding apparatus having dust removal means, comprising an apparatus housing, in which a work plate which is driven by a compressed-air motor is movably supported, an inlet piping connection for compressed air connected in fluid circuit with an inlet opening of said compressed-air motor, a suction piping connection which is connected to the inside of the apparatus housing and to which a suction device can be connected, and a discharge-air piping connection which is connected to an outlet of said compressed-air motor, each of said inlet opening, said discharge-air piping and said suction piping means including passageway means to the exterior of said apparatus housing, the improvement comprising wherein said discharge-air piping connection surrounds said inlet piping connection, wherein said suction piping connection surrounds said inlet piping connection and said discharge piping connection, wherein separate flexible hoses are sealingly connected to said inlet piping connection, said discharge-air piping connection and said suction piping connection, wherein an adapter is provided, to which each of said flexible hoses, which come in the same direction from said inlet piping connection, said discharge-air piping connection and said suction piping connection, are sealingly connected, said adapter having separate axially arranged hose connecting tubes, one sealingly connected to said hose extending to said inlet piping connection, another sealingly connected to said hose extending to said discharge-air piping connection and still another sealingly connected to said hose extending to said suction piping connection, said adapter further having outlet openings aligned in different direction for connection to a compressed-air source, a discharge-air port and a suction device.

2. The grinding apparatus according to claim 1, wherein at least said inlet piping connection and said discharge-air piping connection are arranged coaxially to one another on said grinding apparatus.

3. The grinding apparatus according to claim 1, wherein a sound absorber is connected to one of said outlet openings in said adapter communicating with said discharge-air connection.

4. The grinding apparatus according to claim 1, wherein an oil separator is connected to one of said outlet openings in said adapter communicating with said discharge-air connection.

5. The grinding apparatus according to one of the claims 3 or 4, wherein said outlet opening communicating with said suction piping connection on said adapter is connected directly to said suction device.

6. The grinding apparatus according to claim 1, wherein an outlet opening of said adapter is constructed as a connecting tube which is constructed coaxially with respect to said hose connecting tubes for the exhaust dust-containing air.

7. The grinding apparatus according to claim 6, wherein the axis of the outlet opening for said compressed-air source and the axis of said outlet opening for said discharge-air port define an angle with the common axis of said hose connecting tubes.

8. The grinding apparatus according to claim 6 or 7, wherein said hose connecting tube which carries the flexible suction hose and said outlet opening for said suction device have the same outside diameter.

9. The grinding apparatus according to claim 1, wherein said adapter is a plastic part which is molded in one piece.

10. The grinding apparatus according to claim 1, wherein said hose connecting tubes on said adapter are coaxial.

* * * * *